US011648795B2

(12) United States Patent
Walker

(10) Patent No.: US 11,648,795 B2
(45) Date of Patent: May 16, 2023

(54) DOUBLE SIDED CLIPBOARD

(71) Applicant: Betty J. Walker, Angel Fire, NM (US)

(72) Inventor: Betty J. Walker, Angel Fire, NM (US)

( * ) Notice: Subject to any disclaimer, the term of this patent is extended or adjusted under 35 U.S.C. 154(b) by 337 days.

(21) Appl. No.: 17/020,079

(22) Filed: Sep. 14, 2020

(65) Prior Publication Data

US 2022/0080764 A1 Mar. 17, 2022

(51) Int. Cl.

| | |
|---|---|
| ***B42D 9/00*** | (2006.01) |
| ***B42F 9/00*** | (2006.01) |
| ***A47B 23/04*** | (2006.01) |

(52) U.S. Cl.

CPC ..... *B42F 9/004* (2013.01); *A47B 23/042* (2013.01); *B42F 9/00* (2013.01); *B42F 9/001* (2013.01); *B42P 2241/18* (2013.01)

(58) Field of Classification Search

CPC .. B42F 9/00; B42F 9/001; B42F 9/004; A47B 23/042

See application file for complete search history.

(56) References Cited

U.S. PATENT DOCUMENTS 3,297,862 A * 1/1967 Levy ..... B42F 9/001 362/184
9,204,718 B2 * 12/2015 Magaudda ..... A47B 23/044
2012/0091308 A1 * 4/2012 Small ..... B42F 9/001 248/452

FOREIGN PATENT DOCUMENTS

CN 205705846 U * 11/2016

* cited by examiner

*Primary Examiner* — Kyle R Grabowski

(57) ABSTRACT

A double sided clipboard includes a rigid board, a front fastening mechanism, a rear fastening mechanism, a left opening, a right opening, a left supporting arm, and a right supporting arm. The front fastening mechanism and the rear fastening mechanism are oppositely positioned of each other about a top edge of the rigid board to secure two sets of documents within the rigid board. The front fastening mechanism is connected to a front surface of the rigid board. The rear fastening mechanism is connected to a rear surface of the rigid board. The left opening and the right opening traverses through the rigid board and oppositely positioned of each other about the front fastening mechanism. The left supporting arm is perpendicular attached to the rigid board through the left opening. The right supporting arm is perpendicular attached to the rigid board through the right opening.

17 Claims, 5 Drawing Sheets

DOUBLE SIDED CLIPBOARD

FIELD OF THE INVENTION

The present invention relates generally to a rigid clipboard that is utilized for holding paper in place. More specifically, the present invention is a double sided clipboard to hold two sets of papers on each side of the clipboard.

BACKGROUND OF THE INVENTION

Clipboard is a supporting apparatus to hold a set of papers so that the users can utilize a rigid flat surface to write on the set of papers. Clipboards can be constructed from a variety of material, including but not limited to, hardboard, aluminum, polypropylene, composite material, or any other related material. Clipboards generally come in three different designs such as single, folding, and storage. More specifically, Single clipboards are the more traditional type and consist of a single piece of rigid material and a holding clip at the top of the single piece of rigid material. Folding clipboards are usually constructed from a single piece of flexible PVC with two rigid materials enclosed within. A folding hinge connects the two sections to allow the front to be folded over the content to provide protection and often to allow some sort of promotional print or instructions. Folding clipboards also provide additional benefits because of the extra space available. Storage clipboards functions similar to the single clipboards but has an integrated storage space to store items such as papers, pens, pencils, or other writing utensils. Other than the abovementioned types of clipboards, the existing clipboards have not improved with any additional features that can improve the functionality of the clipboards.

It is therefore an objective of the present invention to provide a double sided clipboard that can retain two set of papers in the front side and the rear side. As a result, the present invention is able to provide two separate places for two separate documents so that user is easily able to view and/or write on both documents. The present invention is also integrated with two supporting arms that are perpendicularly positioned to the clipboard to angularly position the clipboard to the user. As a result, the present invention is able to remove any glare from the clipboard while provide a comfortable angular position to write and/or view the documents. Furthermore, the present invention may be integrated with an illuminating device to view the documents within low light conditions.

DETAIL DESCRIPTIONS OF THE INVENTION

Figure 1:
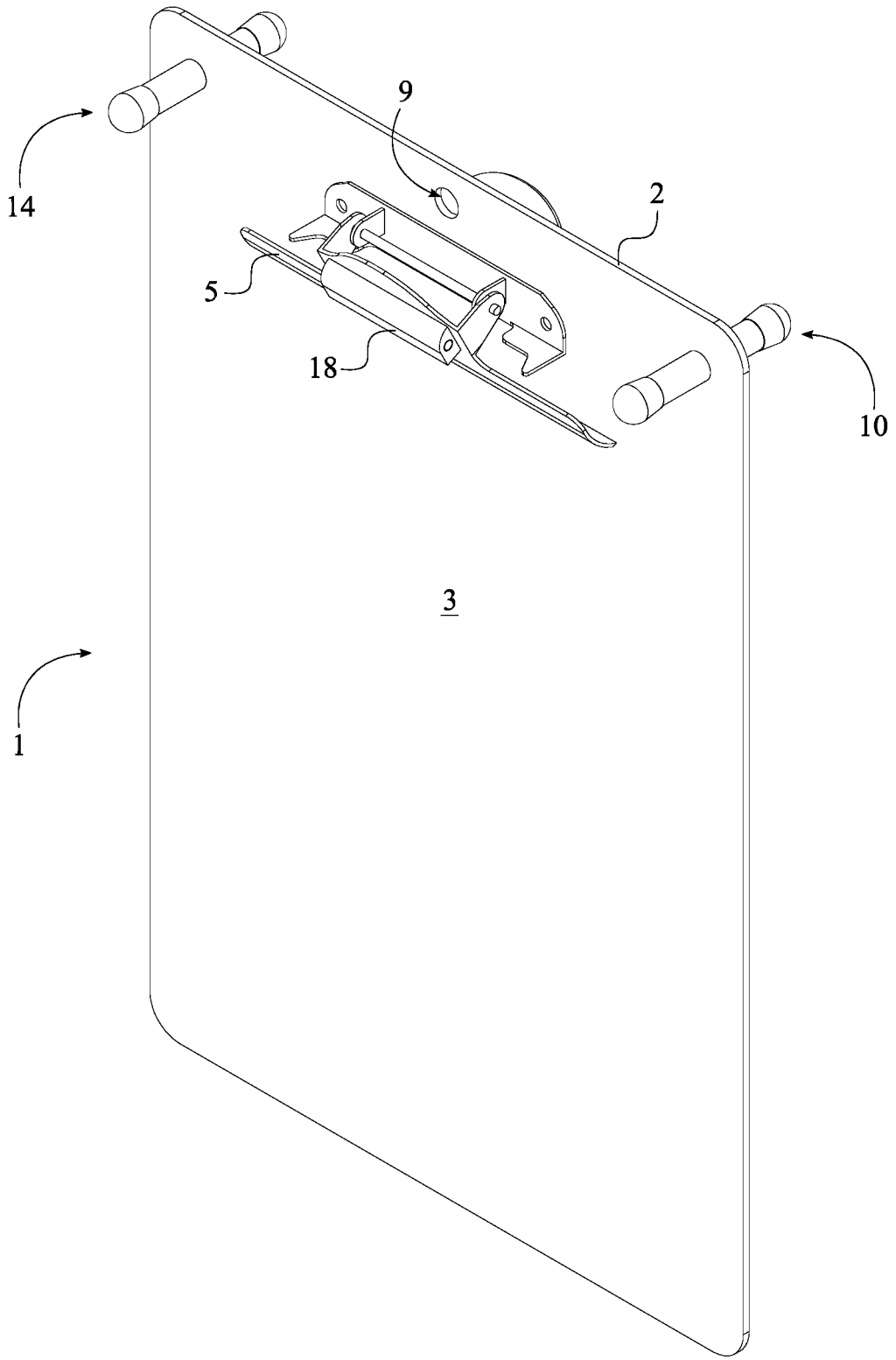
FIG. 1 is a front perspective view of the present invention.

All illustrations of the drawings are for the purpose of describing selected versions of the present invention and are not intended to limit the scope of the present invention.

The present invention is a double sided clipboard, wherein the present invention enables the user to view and/or write on two separate documents without having to flip thought a lot of papers. The present invention can also be angularly positioned on a desk surface ease the writing and viewing process of the two separate documents through an optimal writing and viewing angle. The present invention is also integrated with accessory components that are related to functionality of the clipboard thus providing an improved clipboard apparatus over any existing clipboards. The present invention comprises a rigid board 1, a front fastening mechanism 5, a rear fastening mechanism 6, a left opening 7, a right opening 8, a left supporting arm 10, and a right supporting arm 14 as shown in FIG. 1-2.

Figure 2:
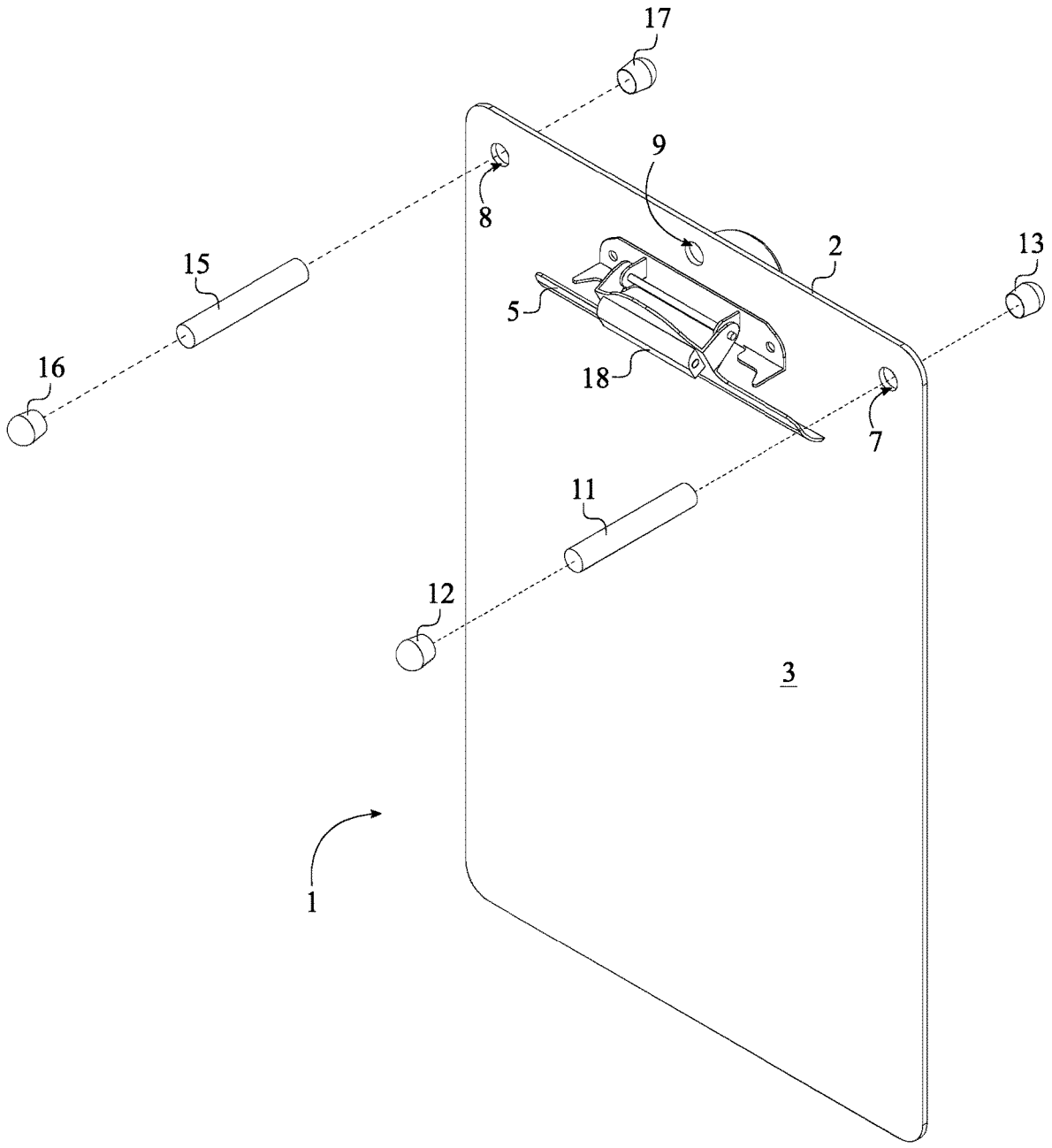
FIG. 2 is a front exploded view of the present invention.

In reference to FIG. 1-2, the rigid board 1 is generally a rectangular shaped board so that the commonly used A4 size standard paper can be placed within an outer parameter of the rigid board 1. However, the present invention is not limited to standard A4 sized papers and can be modified to fit any sized paper. Each corner of the rigid board 1 is preferably a radial corner to eliminate any sharp corners that can be unsafe users. The rigid board 1 is utilized as platform to place two separate documents as a first document can be placed on a front surface 3 of the rigid board 1 and a second document can be placed on a rear surface 4 of the rigid board 1.

Figure 5:
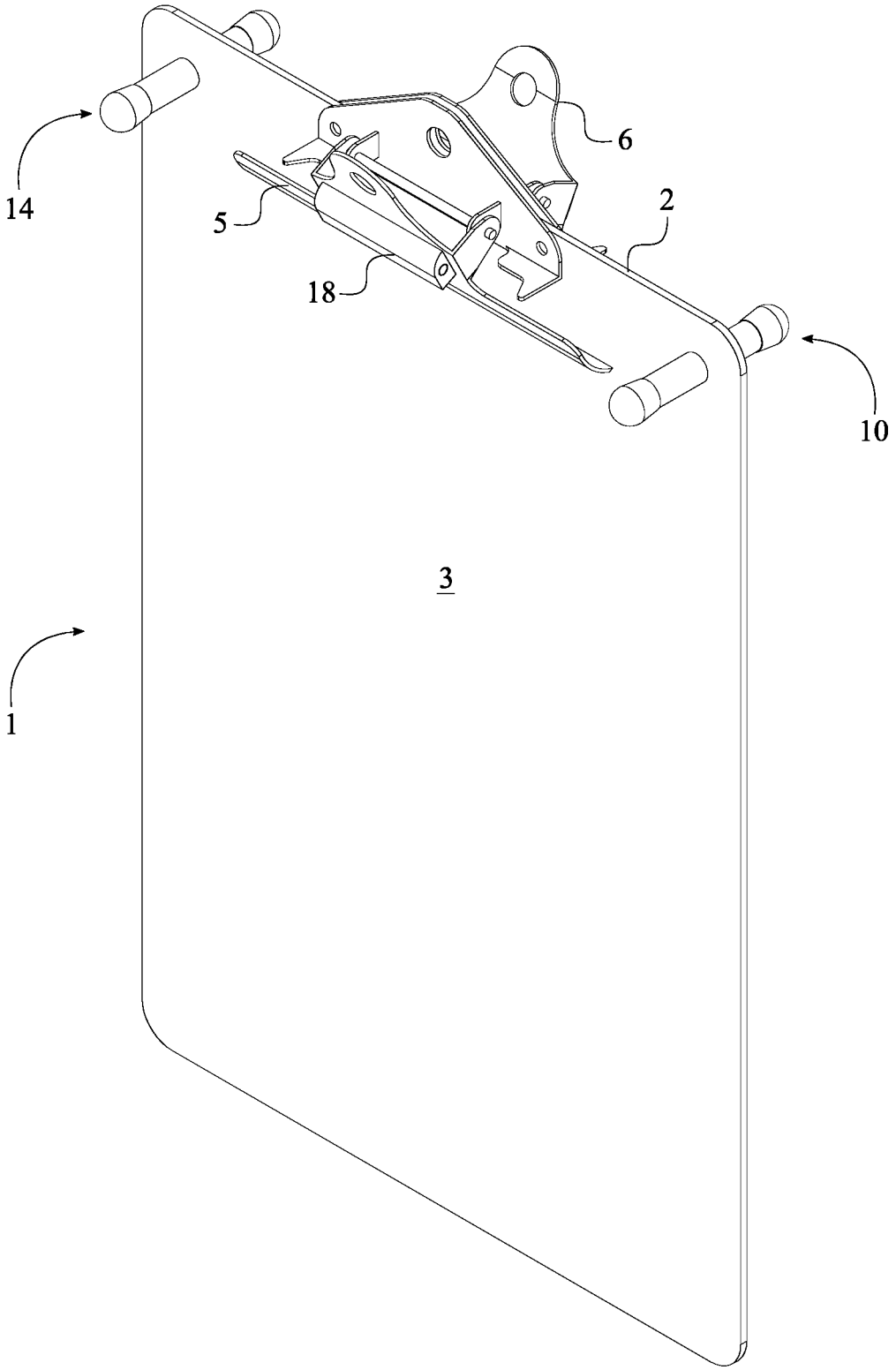
FIG. 5 is a front perspective view of the present invention, wherein the front fastening mechanism and the rear fastening mechanism are outwardly extended away from the rigid board.

The front fastening mechanism 5 and the rear fastening mechanism 6 function as the paper securing apparatus within the present invention so that the first document and the second document can be attached to the rigid board 1. In reference to FIG. 3, the front fastening mechanism 5 and the rear fastening mechanism 6 are oppositely positioned of each other about a top edge 2 of the rigid board 1. The front fastening mechanism 5 is connected to the front surface 3 of the rigid board 1 and positioned along a sagittal plane of the rigid board 1. The rear fastening mechanism 6 is connected to the rear surface 4 of the rigid board 1 and positioned along the sagittal plane of the rigid board 1. Preferably, the front fastening mechanism 5 and the rear fastening mechanism 6 each comprises a connector arm and a spring-loaded clamping arm. The connector arm and the spring-loaded clamping arm are hingedly connected to each other so that the front fastening mechanism 5 and the rear fastening mechanism 6 can be functional. The connector arm of the front fastening mechanism 5 is mounted onto the front surface 3 so that the spring-loaded clamping arm of the front fastening mechanism 5 can be pressed against the front surface 3 to secure the first document to the rigid board 1. The connector arm of the rear fastening mechanism 6 is mounted onto the rear surface 4 so that the spring-loaded clamping arm of the rear fastening mechanism 6 can be pressed against the rear surface 4 to secure the second document to the rigid board 1. Depending upon different embodiment of the present invention, the front fastening mechanism 5 and the rear fastening mechanism 6 can be positioned within the outer parameter of the rigid board 1 or can be partially extended away from the outer parameter of the rigid board 1 as shown in FIG. 1 and FIG. 5.

In reference to FIG. 1-2, the left opening 7, the right opening 8, the left supporting arm 10, and the right supporting arm 14 collectively integrated into the present invention so that the rigid board 1 can be angularly positioned on a desk surface. More specifically, the left opening 7 and the right opening 8 traverse through the rigid board 1 in such a way that the left opening 7 and the right opening 8 are oppositely positioned of each other about the front fastening mechanism 5 and the rear fastening mechanism 6. The left opening 7 and the right opening 8 are positioned adjacent to the top edge 2 and aligned to each other across the rigid board 1. The left supporting arm 10 is perpendicular attached to the rigid board 1 through the left opening 7. The right supporting arm 14 is perpendicular attached to the rigid board 1 through the right opening 8. Then, the left supporting arm 10 and the right supporting arm 14 are able to elevate the top edge 2 of the rigid board 1 from the desk surface thus resulting the angular positioning of the rigid board 1. The angular positioning of the rigid board 1 provides a comfortable writing angle for the user's wrist, provides an optimal viewing angle to view any documents, and eliminates any possible glare that can cause due to lighting issues.

In reference to FIG. 2, the left supporting arm 10 that elevates the left top edge 2 of the rigid board 1 comprises a left elongated body 11, a front-left cap 12, and a rear-left cap 13. More specifically, the left elongated body 11 is concentrically positioned within the left opening 7 and centrally positioned to the rigid board 1. The left elongated body 11 is frictionally attached to the rigid board 1 through the left opening 7 so that the left elongated body 11 can perpendicularly positioned with the rigid board 1. The front-left cap 12 is terminally attached to the left elongated body 11 and positioned adjacent to the front surface 3. As a result, the front-left cap 12 is able to hide any sharp edges of the left elongated body 11 with respect the front surface 3. The rear-left cap 13 is terminally attached to the left elongated body 11 and positioned adjacent to the rear surface 4. As a result, the rear-left cap 13 is able to hide the remaining sharp edges of the left elongated body 11 with respect to the rear surface 4.

In reference to FIG. 2, the right supporting arm 14 that elevates the left top edge 2 of the rigid board 1 comprises a right elongated body 15, a front-right cap 16, and a rear-right cap 17. More specifically, the right elongated body 15 is concentrically positioned within the right opening 8 and centrally positioned to the rigid board 1. The right elongated body 15 is frictionally attached to the rigid board 1 through the right opening 8 so that the right elongated body 15 can perpendicularly positioned with the rigid board 1. The front-right cap 16 is terminally attached to the right elongated body 15 and positioned adjacent to the front surface 3. As a result, the front-right cap 16 is able to hide any sharp edges of the right elongated body 15 with respect to the front surface 3. The rear-right cap 17 is terminally attached to the right elongated body 15 and positioned adjacent to the rear surface 4. As a result, the rear-right cap is able to hide the remaining sharp edges of the right elongated body 15 with respect to the rear surface 4.

Furthermore, a length of the left elongated body 11 and the right elongated body 15 determines the specific angle between the rigid board 1 and the desk surface as the specific angle is less than a right angle. In order to provide a balance surface within the present invention, the length of the left elongated body 11 is equal to the length of the right elongated body 15.

In reference to FIG. 1-2, in some embodiment of the present invention further comprises a middle opening 9 so that the rigid board 1 can be hanged on a wall. More specifically, the middle opening 9 is centrally positioned in between the left opening 7 and the right opening 8 and aligned to the sagittal plane of the rigid board 1. The middle opening 9 is positioned adjacent to the top edge 2 and traverses through the rigid board 1 so that a wall hook or nail can be inserted through the middle opening 9. More specifically, when the front fastening mechanism 5 and the rear fastening mechanism 6 are positioned within the outer parameter of the rigid board 1, the middle opening 9 is utilized to hang the rigid board 1. Furthermore, the middle opening 9 can also be utilized to store a writing utensil when the user has to take a break or interrupted from the writing process for easy organization. When the writing utensil is stored within the middle opening 9, the writing utensil is generally positioned upright and can be easily accessible by the user.

In reference to FIG. 5, in some embodiment of the present invention, a board-hanging opening can be integrated into the front fastening mechanism 5 or the rear fastening mechanism 6 instead of the middle opening 9. More specifically, when the front fastening mechanism 5 and the rear fastening mechanism 6 are outwardly extended away from the outer parameter of the rigid board 1, the board-hanging opening is utilized to hang the rigid board 1.

Figure 3:
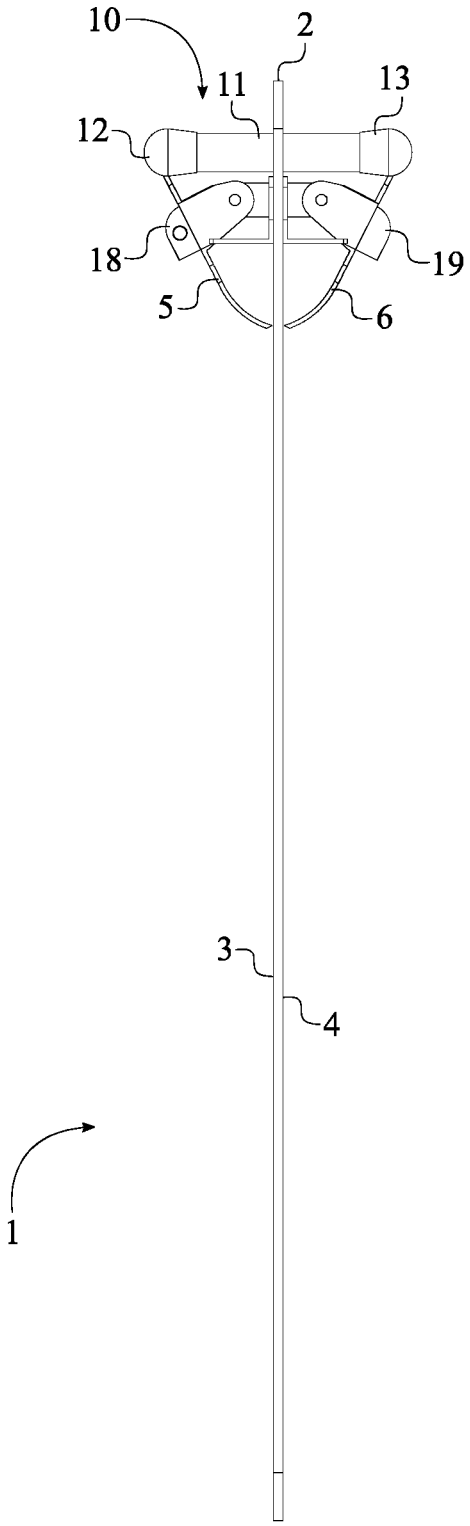
FIG. 3 is a left side view of the present invention.

In reference to FIG. 1-3, the present invention further comprises a front illuminating device 18 and a rear illuminating device 19. The front illuminating device 18 is integrated into the front fastening mechanism 5. As a result, the user can turn-on the front illuminating device 18 to provide additional lighting effect to the first document that is placed on the front surface 3. The rear illuminating device 19 is integrated into the rear fastening mechanism 6. As a result, the user can turn-on the rear illuminating device 19 to provide additional lighting effect to the second document that is placed on the rear surface 4. The front illuminating device 18 and the rear illuminating device 19 are self-contained devices, wherein each illuminating device is configured with at least one light source that is electrically powered by a power source via a power switch.

Figure 4:
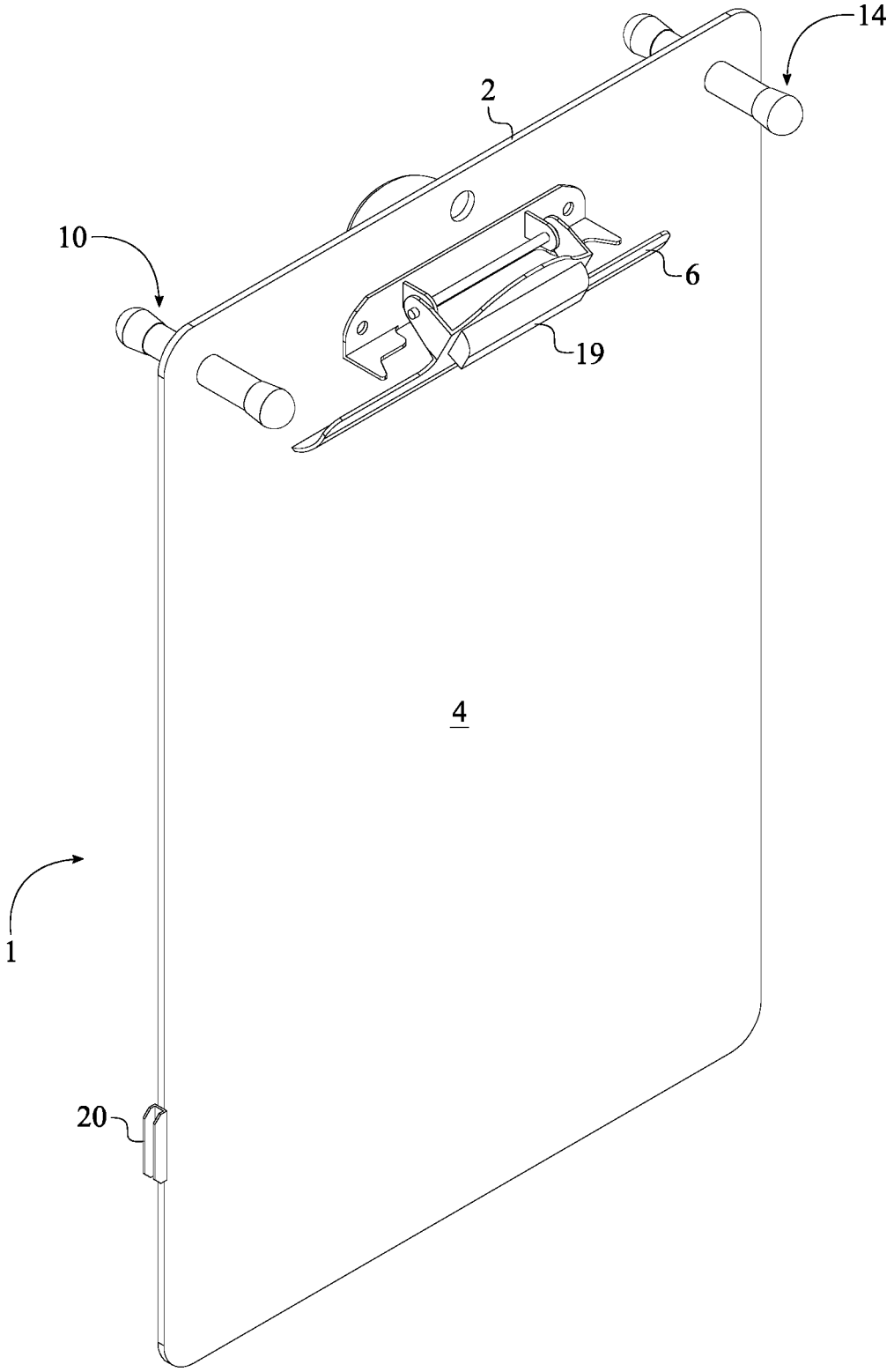
FIG. 4 is a rear perspective view of the present invention showing the attached writing utensil holder.

In reference to FIG. 4, the present invention further comprises a writing utensil holder 20. More specifically, the writing utensil holder 20 is perimetrically connected to the rigid board 1 so that any kind of writing utensils such as a pen, pencil, marker, and other similar items can be mounted to the present invention. Due to the perimetrical positioning of the writing utensil holder 20, the user is able to access the stored writing utensil from the front surface 3 or the rear surface 4 of the rigid board 1 without having to interfere with the first document or the second document.

Although the invention has been explained in relation to its preferred embodiment, it is to be understood that many other possible modifications and variations can be made without departing from the spirit and scope of the invention as hereinafter claimed.

What is claimed is:

1. A double sided clipboard comprising:

a rigid board;

a front fastening mechanism;

a rear fastening mechanism;

a left opening;

a right opening;

a left supporting arm;

a right supporting arm;

the front fastening mechanism and the rear fastening mechanism being oppositely positioned of each other about a top edge of the rigid board;

the front fastening mechanism being connected to a front surface of the rigid board;

the rear fastening mechanism being connected to a rear surface of the rigid board;

the left opening and the right opening traversing through the rigid board;

the left opening and the right opening being oppositely positioned of each other about the front fastening mechanism;

the left opening and the right opening being positioned adjacent to the top edge;

the left supporting arm being perpendicular attached to the rigid board through the left opening;

the right supporting arm being perpendicular attached to the rigid board through the right opening;

the left supporting arm comprising a left elongated body, a front-left cap, and a rear-left cap;

the left elongated body being concentrically positioned within the left opening;

the left elongated body being centrally positioned to the rigid board;

the left elongated body being frictionally attached to the rigid board through the left opening;

the front-left cap being terminally attached to the left elongated body;

the front-left cap being positioned adjacent to the front surface;

the rear-left cap being terminally attached to the left elongated body; and the rear-left cap being positioned adjacent to the rear surface.

2. The double sided clipboard as claimed in claim 1, wherein the rigid board is a rectangular shaped board.

3. The double sided clipboard as claimed claim 1 comprising:

the right supporting arm comprising a right elongated body, a front-right cap, and a rear-right cap;

the right elongated body being concentrically positioned within the right opening;

the right elongated body being centrally positioned to the rigid board;

the right elongated body being frictionally attached to the rigid board through the right opening;

the front-right cap being terminally attached to the right elongated body;

the front-right cap being positioned adjacent to the front surface;

the rear-right cap being terminally attached to the right elongated body; and the rear-right cap being positioned adjacent to the rear surface.

4. The double sided clipboard as claimed claim 1 comprising:

a middle opening;

the middle opening being centrally positioned in between the left opening and the right opening;

the middle opening being positioned adjacent to the top edge; and the middle opening traversing through the rigid board.

5. The double sided clipboard as claimed claim 1 comprising:

a front illuminating device; and the front illuminating device being integrated into the front fastening mechanism.

6. The double sided clipboard as claimed claim 1 comprising:

a rear illuminating device; and the rear illuminating device being integrated into the rear fastening mechanism.

7. The double sided clipboard as claimed claim 1 comprising:

a writing utensil holder; and the writing utensil holder being perimetrically connected to the rigid board.

8. A double sided clipboard comprising:

a rigid board;

a front fastening mechanism;

a rear fastening mechanism;

a left opening;

a right opening;

a left supporting arm;

a right supporting arm;

a middle opening;

the front fastening mechanism and the rear fastening mechanism being oppositely positioned of each other about a top edge of the rigid board;

the front fastening mechanism being connected to a front surface of the rigid board;

the rear fastening mechanism being connected to a rear surface of the rigid board;

the left opening and the right opening traversing through the rigid board;

the left opening and the right opening being oppositely positioned of each other about the front fastening mechanism;

the left opening and the right opening being positioned adjacent to the top edge;

the middle opening being centrally positioned in between the left opening and the right opening;

the middle opening being positioned adjacent to the top edge;

the middle opening traversing through the rigid board;

the left supporting arm being perpendicular attached to the rigid board through the left opening;

the right supporting arm being perpendicular attached to the rigid board through the right opening;

the left supporting arm comprising a left elongated body, a front-left cap, and a rear-left cap;

the left elongated body being concentrically positioned within the left opening;

the left elongated body being centrally positioned to the rigid board;

the left elongated body being frictionally attached to the rigid board through the left opening;

the front-left cap being terminally attached to the left elongated body;

the front-left cap being positioned adjacent to the front surface;

the rear-left cap being terminally attached to the left elongated body; and the rear-left cap being positioned adjacent to the rear surface.

9. The double sided clipboard as claimed in claim 8, wherein the rigid board is a rectangular shaped board.

10. The double sided clipboard as claimed claim 8 comprising:

the right supporting arm comprising a right elongated body, a front-right cap, and a rear-right cap;

the right elongated body being concentrically positioned within the right opening;

the right elongated body being centrally positioned to the rigid board;

the right elongated body being frictionally attached to the rigid board through the right opening;

the front-right cap being terminally attached to the right elongated body;

the front-right cap being positioned adjacent to the front surface;

the rear-right cap being terminally attached to the right elongated body; and the rear-right cap being positioned adjacent to the rear surface.

11. The double sided clipboard as claimed claim 8 comprising:

a front illuminating device; and the front illuminating device being integrated into the front fastening mechanism.

12. The double sided clipboard as claimed claim 8 comprising:

a rear illuminating device; and the rear illuminating device being integrated into the rear fastening mechanism.

13. The double sided clipboard as claimed claim 8 comprising:

a writing utensil holder; and the writing utensil holder being perimetrically connected to the rigid board.

14. A double sided clipboard comprising:

a rigid board;

a front fastening mechanism;

a rear fastening mechanism;

a left opening;

a right opening;

a left supporting arm;

a right supporting arm;

a middle opening;

a front illuminating device;

a rear illuminating device;

the front fastening mechanism and the rear fastening mechanism being oppositely positioned of each other about a top edge of the rigid board;

the front fastening mechanism being connected to a front surface of the rigid board;

the front illuminating device being integrated into the front fastening mechanism;

the rear fastening mechanism being connected to a rear surface of the rigid board;

the rear illuminating device being integrated into the rear fastening mechanism;

the left opening and the right opening traversing through the rigid board;

the left opening and the right opening being oppositely positioned of each other about the front fastening mechanism;

the left opening and the right opening being positioned adjacent to the top edge;

the middle opening being centrally positioned in between the left opening and the right opening;

the middle opening being positioned adjacent to the top edge;

the middle opening traversing through the rigid board;

the left supporting arm being perpendicular attached to the rigid board through the left opening;

the right supporting arm being perpendicular attached to the rigid board through the right opening;

the left supporting arm comprising a left elongated body, a front-left cap, and a rear-left cap;

the left elongated body being concentrically positioned within the left opening;

the left elongated body being centrally positioned to the rigid board;

the left elongated body being frictionally attached to the rigid board through the left opening;

the front-left cap being terminally attached to the left elongated body;

the front-left cap being positioned adjacent to the front surface;

the rear-left cap being terminally attached to the left elongated body; and the rear-left cap being positioned adjacent to the rear surface.

15. The double sided clipboard as claimed in claim 14, wherein the rigid board is a rectangular shaped board.

16. The double sided clipboard as claimed claim 14 comprising:

the right supporting arm comprising a right elongated body, a front-right cap, and a rear-right cap;

the right elongated body being concentrically positioned within the right opening;

the right elongated body being centrally positioned to the rigid board;

the right elongated body being frictionally attached to the rigid board through the right opening;

the front-right cap being terminally attached to the right elongated body;

the front-right cap being positioned adjacent to the front surface;

the rear-right cap being terminally attached to the right elongated body; and the rear-right cap being positioned adjacent to the rear surface.

17. The double sided clipboard as claimed claim 14 comprising:

a writing utensil holder; and the writing utensil holder being perimetrically connected to the rigid board.

* * * * *